United States Patent [19]

Bächtiger

[11] 4,148,604

[45] Apr. 10, 1979

[54] APPLYING A REINFORCING SUBSTANCE TO A MATERIAL HAVING A TEXTILE SURFACE

[75] Inventor: Hans Bächtiger, Stallikon, Switzerland

[73] Assignee: Gygli Technik AG, Zug, Switzerland

[21] Appl. No.: 793,735

[22] Filed: May 4, 1977

[30] Foreign Application Priority Data

Oct. 29, 1976 [CH] Switzerland ..... 13684/76

[51] Int. Cl.[2] ..... D06M 13/34

[52] U.S. Cl. ..... 8/181; 8/150; 68/200; 427/282; 427/28 B; 427/288

[58] Field of Search ..... 8/181, 150; 427/282, 427/286, 288; 68/200

[56] References Cited

U.S. PATENT DOCUMENTS 3,967,009 6/1976 Blake ..... 427/282

FOREIGN PATENT DOCUMENTS 2535593 2/1976 Fed. Rep. of Germany.

510203 7/1939 United Kingdom.

911517 11/1962 United Kingdom.

1025463 4/1966 United Kingdom.

1403852 8/1975 United Kingdom.

1433957 4/1976 United Kingdom.

*Primary Examiner*—A. Lionel Clingman

*Attorney, Agent, or Firm*—Flynn & Frishauf

[57] ABSTRACT

The material is located at one side of the screen of a screen printing stencil, the other side of which has the reinforcing substance, for example curable plastic material, applied, uniformly distributed over the screen. To apply the substance to the material, the screen is located at the end of a closed pressure vessel into which the reinforcing substance is introduced and to which, further, controlled pneumatic pressure is applied when printing is desired, to flow the reinforcing substance through the openings of the screen, and bulge the screen outwardly, for example into contact with the material to be reinforced. After application of the material, the pressure is released, permitting the screen to return to normal position and spaced from the material.

9 Claims, 4 Drawing Figures

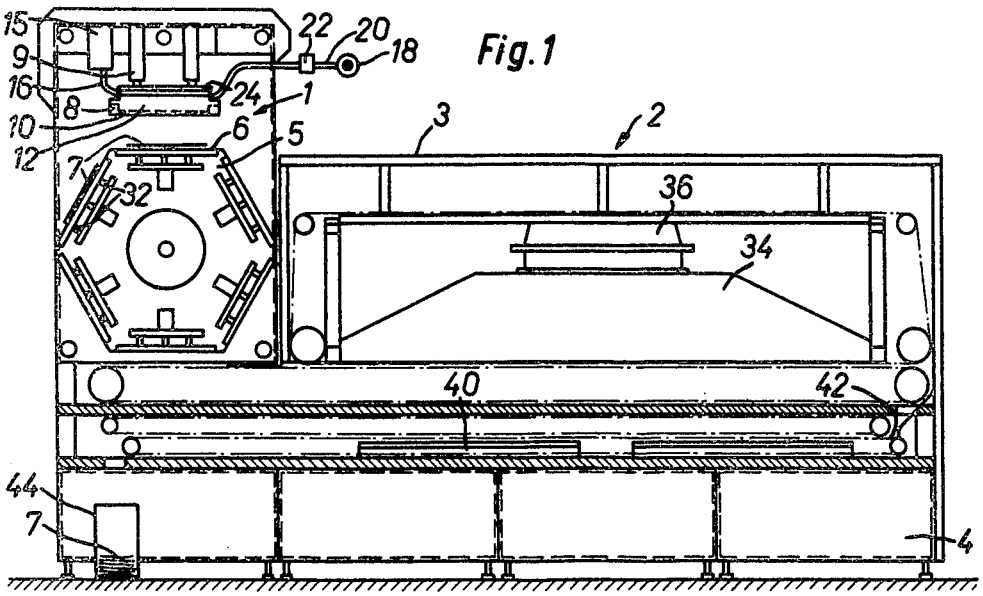
Fig. 1
Fig. 2
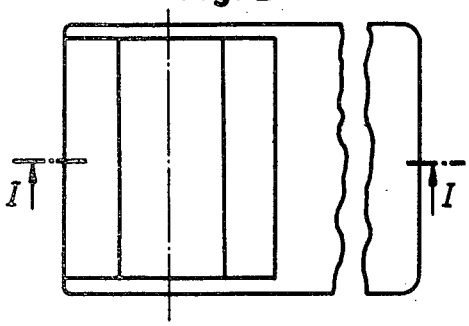
Fig. 3
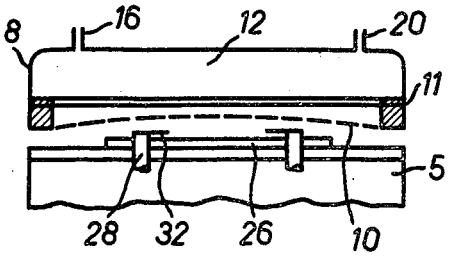
Fig. 4
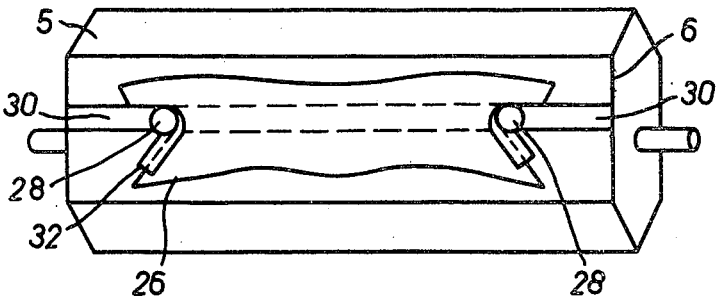

APPLYING A REINFORCING SUBSTANCE TO A MATERIAL HAVING A TEXTILE SURFACE

The present invention relates to the art of reinforcing materials having textile surface, and more particularly to a method and apparatus therefor in which a flowable reinforcement or stiffening substance is applied to the surface by means of screen printing.

It has previously been proposed to apply reinforcing substances, such as various plastic materials, to textile carriers, or other materials having a textile surface. After applying the substance, it is dried and may be subjected to further treatment, such as curing or the like.

In accordance with a previously known method—see Swiss Pat. No. 208,340 (to which British 510,203 corresponds) - materials having textile surfaces are reinforced by application of a reinforcing material, when in semi-finished form, by applying thereto a colorless reinforcing liquid. This reinforcing liquid substance includes a solvent which, after evaporation, should not have adhesive remanent effects with respect to adjacent textile layers. The reinforcing substance is applied in controlled manner so that the resulting stiffness or flexibility of the final material can be matched to the proposed use and may well differ with respect to other articles having the same substance applied. The differences in degree of stiffness are obtained by using solutions of the substance of different concentration, masking certain regions of the materials, or applying different quantities of the reinforcing material. The difference in quantity of application can be obtained, for example, by pressure spraying with different spray pressures, or by partial masking with mesh, for example wire mesh, of different percentages of clear passage of the liquid reinforcing material.

Another embodiment of such a process has been described in British Pat. No. 911,517; the material has applied thereto the reinforcing substance which is capable of curing or hardening under application of heat. It is applied in the form of an aqueous emulsion, dispersion, or melt, for example by means of an engraved roller, or by a hollow stencil. This permits application of reinforcing substance in different quantities, so that different degrees of stiffness, or flexibility, respectively, of various portions of the material to be reinforced, can be obtained.

German Disclosure Document DT-OS No. 25 35 593 discloses the use of known printing processes, such as raised printing, intaglio or gravure printing, or screen printing, in order to apply reinforcing substances to materials having a textile surface.

The various printing processes which have been described and proposed in the prior art all show some disadvantages. Printing methods, as proposed, require substantial time to apply the reinforcing material and thus are not suitable for efficient manufacturing processes; matching of the quantity of the substance to be applied to the specific surface portion of the material to be reinforced is difficult and frequently possible only to a rather restricted extent. The known printing methods are not generally suitable to handle the customary reinforcing materials which, for good penetration of the fibers of the textile surface, should not be highly viscous—like printing ink—but rather should form droplets. Use of the known printing processes to apply reinforcing material is thus very time-consuming.

It is an object of the present invention to provide a process and an apparatus to apply reinforcing substance to a textile surface of a material in which the time of application of the material is short, which permits use of a wide variety of stiffening or reinforcing materials and easily permits adjustment of the quantity to be applied, while additionally permitting application of the substance in different strength, or at different points of the material having the textile surface. As an ancillary object, the apparatus should be so arranged that it is but little larger than the material to be reinforced and is subject to only small mechanical loading so that it will have a long life.

Subject Matter of the Present Invention

Briefly, a screen stencil is provided adjacent one side of which the reinforcing substance is placed. The material to be reinforced is located at the other side of the screen stencil, preferably spaced slightly therefrom. Preferably, the application of the reinforcement substance is carried out in steps i.e. in an intermittent batch process, rather than continuously, by sequentially treating blanks of the material. The reinforcing substance is applied to the side of the screen stencil in uniform distribution and held at a level which is spaced from the level of the screen itself, so that a certain quantity of liquid reinforcing substance is retained above the stencil. During screen printing itself, the extent of application of the reinforcing substance to the material with the textile surface is controlled by controlling pressure on the printing stencil; in accordance with a preferred feature of the invention, the printing stencil forms the end surface of a closed pressure vessel and the pressure is applied, for example pneumatically, against the reinforcing substance in the interior of the pressure vessel, to be squeezed out through the screen openings of the screen against the material to be reinforced. The screen, if spaced slightly from the material, can then bulge outwardly. After application of the reinforcing material, the pressure is released and the screen can return to its original shape to permit placing another one of the materials under the screen.

The apparatus preferably includes a stepped transport arrangement located beneath the pressure vessel which holds the reinforcing substance. The stepped transport arrangement may be a drum having plane surfaces, such as a hexagonal drum, on which the blanks of the material to be reinforced is secured. The drum is located beneath the pressure vessel, the bottom of which is formed by the screen stencil. The remaining walls are airtight. The vessel is connected to a pressure source which, selectively, permits application of pressure thereto at an adjustable level.

Drawings, illustrating an example:

FIG. 1 is a highly schematic side view, partly in section, of an apparatus to reinforce strips of material having a textile surface;

FIG. 2 is a top view of the apparatus of FIG. 1, partly broken away;

FIG. 3 is a fragmentary vertical section through the printing screen and the counter and transport surface, to an enlarged scale; and FIG. 4 is a top view of the transport arrangement and showing the counter surface and the material holder.

The present invention proceeds from the consideration that screen printing is a suitable process to apply reinforcing material to a textile surface but, unfortunately, the usual or customary screen printing process is not capable of handling the usual type of reinforcing substances. Conventional screen printing apparatus, if intended to be used, would place severe limitations on the choice of reinforcing materials. Thus, conventional screen printing apparatus cannot be used, commercially and effectively, in the process to apply reinforcing substances to a textile material. Yet, stencil screens as used in the screen printing apparatus are employed, although in a method and in a manner different from that in customary screen printing applications, as will appear in detail below.

The apparatus (FIG. 1) essentially has two portions: a printing part 1 to apply the stiffening substance on the textile material or, if on a substrate, on the material having a textile surface; and a drying and post-treatment portion 2. The drying and post-treatment portion 2 can be conventional and while cooperating with the apparatus to apply the reinforcing substance does not, as such, form part of the present invention. It is therefore shown only schematically and described only briefly. The portion 2 can be constructed in various ways, other than as shown, without affecting the present invention.

The essential portions of the printing part 1 and of the drying and post-treatment part 2 are covered by a housing 3 which is secured to a frame 4. The frame 4 also journals a conveyor apparatus shown as a transport drum 5. Transport drum 5 is constructed as a hexagonal prism; drums having any other number of flat plane sides, or even cylinders, can be used. Other transport or conveyor arrangements, such as belt conveyors and the like may also be used.

The lateral surfaces 6 of the transport drum 5 are arranged to accept the material elements which are to be reiforced. These material elements may, for example, be inserts used to provide for stiffening and shaping of garments. FIG. 1 shows the apparatus in the working position, in which a side 6 of drum 5, with material secured thereto, is located immediately beneath a pressure vessel 8. The pressure vessel 8 is vertically movably secured to an upright post 9; post 9 is shown only in schematic form and, in an actual construction, may be a frame structure. The pressure vessel 8 is gas-tight. Its bottom is formed by a screen stencil 10. The screen stencil 10 is secured in a frame 11 (FIG. 3), for example by adhesion, and tightly stretched therein. Frame 11 is secured to the pressure vessel 8. The screen stencil has a pattern applied thereto by any well-known patterning method, for example by photogravure. Application of the pattern permits later application of the reinforcing substance in predetermined positions and with predetermined, metered quantity.

The inner space of the pressure vessel 8 is filled with the reinforcing substance. This reinforcing substance is comparatively thin-flowing and liquid. Its level is maintained by a control system, not further shown or described, which may include a float, the vertical position of which determines additional supply of reinforcing substance. The float maintains the liquid in vessel 8 at an essentially constant level. A supply container 19 is located above vessel 8, which is connected over a line 16 to a metering valve controlled, for example, by the float and communicating with vessel 8. Thus, by means of a well-known control arrangement of this type, additional reinforcing substance can be introduced to the vessel 8 to maintain its liquid level essentially constant.

A pneumatic pressure source 18 provides pneumatic pressure. It is connected by line 20 to the interior of the vessel 8. The pressure within the interior of the vessel 8 is controlled by a pressure regulator 22.

The screen stencil 10 can be accurately aligned with the material held on the transport drum 5 by adjusting the position of the pressure vessel towards the right or left, with respect to FIG. 1, and in and out of the plane of the drawing, as schematically indicated by the crossed arrows. The pressure vessel is secured in a frame 24 carried on the frame or upright 9. The adjustment of the pressure vessel 8 in frame 24, in two axes, can be arranged similarly to the placement of a cross slide table on machine tools, and fixed in position, for example, by means of locking screws, as well known.

The plane lateral sides 6 of drum 5 have a counter-pressure surface 26 secured thereto. Adjustable stops 28 are provided to center the counter-pressure surface 26 as well as the material with the textile surface thereon which is to b- reinforced. Springs—not shown—apply bias pressure to the stops 28, which are slidable in a slot 30 formed in the surface 6. The counter-pressure surface 26 covers the slot 30 in the region of the material 7 which is to be treated.

The material 7 is held in position on the counter-pressure surface 26 by holders 32 to prevent adhesion of the material 7 to the screen after application of the reinforcing material.

Other ways of securing material 7 to the drum 5 may be used, for example vacuum applied against the interior to hold the counter surface 26 and material 7, or to hold the material 7 directly on the drum 5.

The drying and treatment portion 2 includes a dryer 34, for example a drying chamber to which heated air is applied by blower 36. The treated material parts 7 are transported from drum 5 to conveyor system 38 which passes through the drying chamber 34. After the material has passed the drying chamber 34, the material elements 7 are passed through a curing path 40. The temperature in the curing path 40 is increased in order to obtain desired chemical reactions. The curing path 40 also includes conveyor system 42 to carry the elements 7 through the curing path 40. The curing path 40 may take any suitable form; it can be linearly arranged, as shown, or a drum may be used. After the material elements 7 have passed through the curing path 40, they are placed in a loading stack 44 for further handling, transport, or the like.

Operation: Materials 7, with a textile surface, are located on respective side surfaces of the transport drum 5, for example by manually placing the untreated, unreinforced surface elements thereon and holding them by holders 32 (FIG. 2). With the material 7 applied, the drum is rotated to the position of FIG. 1 to place the material 7 beneath the pressure vessel 8. Pressure vessel 8 is then lowered on the post or frame 9, as indicated by the lower portion of the double arrow, until the screen stencil 10 is just slightly above the element 7; it may also be lowered to be immediately adjacent the level of the element 7, that is, just barely in contact therewith. The pressure control valve 22 is then controlled to apply pressure from source 18 through line 20 to the interior 12 of the pressure vessel 8. As a result, the screen stencil will bulge downwardly to fit against the textile surface element 7 (see FIG. 1). A certain amount of reinforcing material will flow through the screen openings of the screen stencil. The quantity of reinforcing substance being applied can be accurately metered by controlling the pressure applied to the interior of vessel 8 from source 18, for example by controlling source 18 or valve 22. The application step is interrupted or can be abruptly terminated by changing of the pressure relationship, for example by applying a vaccum to the interior of the vessel 8. This will raise the screen stencil to the bulged-upwardly position, as shown in FIG. 3, and lift the screen stencil off the element 7. The entire pressure vessel 8 is then raised, in the direction of the upward portion of the double arrow 8, to permit the drum 5 to index to the next position so that the next subsequent element 7 with the textile surface thereon can be placed in position beneath the screen, and hence beneath the pressure vessel 8. The next element 7 is then treated in the same way.

When the treated elements 7 have reached the bottom-most position of the drum 5, the holders 32 are opened—either manually or automatically—and thus permit the now treated elements 7 to drop on the conveyor arrangement 38 to dry the elements and then thereafter cure the elements in the curing path 40, as well known, and as described above in connection with the apparatus 2.

Application of the reinforcing substance is controlled by controlling the pressure in the interior 12 of the pressure vessel 8. Control of the pressure within vessel 8 permits elimination of the previous constrainst on application of reinforcement substance by screen and other printing methods. A comparatively thin-flowing, highly liquid substance can thus be applied with accurate control of the quantity of application of the substance.

Many possibilities suggest themselves to influence the conditions of applications of the reinforcing substance: A change in the passing capacity of the screen stencil; the flow conditions of the reinforcing material; pressure; vaccum; time and intensity of pressure and vacuum, respectively.

The reinforcing substance can be applied to materials having textile surfaces, for example textile materials themselves, which are located on solid counter surfaces 26; the counter surfaces 26 may, however, also be porous. The application of the reinforcing substance can be controlled, additionally, by controlling pressure, and specifically vacuum, beneath a porous counter surface 26 and applied, for example, to the interior of drum 5. The passage rate of flow through such a porous surface, that is, the degree of porosity, can also be variable with respect to various surfaces of the drum 5, to provide for differential treatment of specific areas of the material 7. Thus, for example, the left portion of drum 5 or, rather, the counter surface of drum 5 at the left side of the material 7 (referring to FIG. 4) may have a different degree of porosity than that of another portion, to thereby additionally influence the degree of application of reinforcing material to the element 7 as pressure is being applied to the vessel 8. The pressure pump 18 preferably is of the type which provides, selectively, pressure or vacuum; different arrangements may be used, for example separate pumps applying, respectively, pneumatic pressure or vacuum only, and suitably controlled by control valves 22. The control valves 22, themselves, can be interlocked with operation of drum 5 to be automatically energized, with or without timer elements, or can be manually controlled, as required by the specific reinforcing process.

The screens 10 are preferably fitted in frames as shown; the frames may additionally carry punching or cutting elements so that, in one operation, reinforcing material is applied to the elements 7 while they are, simultaneously, cut or punched during the downward movement of the vessel 8.

Few restrictions are encountered in the use of various types of reinforcing materials. By suitable choice of the pressure relationships during application thereof, the required quantity can readily be metered and the desired result of reinforcing thereby obtained.

The elements 7 with textile surfaces may be in the form of strips or webs, portions of strips, or already cut or punched portions forming part of textile woven material, knitted material, felted or matted materials, or the like.

The stiffening substances can use any suitable products which are customarily applied; their selection is based on the ultimate use. Under suitable conditions they may react with the material 7 itself, or with other substances with which the material 7 has been soaked. The reaction can be chemical and, for example, is intended to maintain the dimensional stability of the element 7, particularly during the reaction time. Products customary in the textile industry may be used, for example urea formaldehyde precondensates; melamine compounds; carbamide; acetal; compounds of ethylene urea type; dihydroxyethylene urea; dihydroxymethyldiethylene urea; homologs of those and similar chemical configuration, alone, or in combination with others of the named products, separately, or in combination with a suitable catalyst. Catalysts used are usually organic or inorganic acids, metal salts or organic or inorganic acids as, for example, alkali metal halides or alkaline earth metal halides or an ammonium salt. Other products may be used, for example monomers which can be reacted with the material of the element 7, or with itself, during condensation or polymerization steps, upon addition or poly-addition, or polymerization or other chemical reactions which may occur with or without splitting off of further reaction products. Typical examples would be styrene, ethylene, propylene, and the like.

Various changes and modifications may be made within the scope of the inventive concept.

I claim:

1. Method of reinforcing material (7) having a textile surface, in which the material with the textile surface is exposed to a liquid reinforcing substance, and the reinforcing substance is applied to the surface by screen printing, said method comprising, the steps of providing a vessel (8) having a screen printing stencil (10) forming one wall thereof;

locating said material (7) adjacent one side of the stencil with the textile surface facing the stencil;

introducing the reinforcing liquid substance into the vessel, and hence on the other side of the stencil, distributed over the stencil;

maintaining the level of liquid reinforcing substance within the vessel at a predetermined depth from the side of the stencil to which said substance is applied;

subjecting the reinforcing substance within said vessel to fluid pressure to force the reinforcing substance through the screen into said material by subjecting the interior of the vessel to fluid pressure, the quantity of reinforcing substance being applied depending on the pressure to the reinforcing substance;

and then releasing the fluid pressure from the vessel.

2. Method according to claim 1, wherein the step of locating the material adjacent the screen comprises the step of intermittently positioning blanks of the material beneath the screen.

3. Method according to claim 1, wherein the step of subjecting the reinforcing substance to fluid pressure comprises applying pneumatic pressure to said substance.

4. Method according to claim 3, wherein the step of applying pneumatic pressure comprises controlling the pressure.

5. Method according to claim 1, wherein the pressure on the screen is maintained constant before, during and after application of said substance to said material.

6. Method according to claim 1, wherein the step of locating the material adjacent a side of the stencil comprises positioning the material adjacent the stencil with a slight distance or spacing therefrom and the step of subjecting the vessel to fluid pressure comprises subjecting said liquid reinforcing substance to pressure of a magnitude sufficient to deform the screen to span said slight distance and essentially contact said material to thereby apply said liquid substance to said material.

7. Method according to claim 1, further comprising the step of interrupting application of said substance by reducing said pressure.

8. Method according to claim 6, further comprising, after the pressure releasing step, the step of, applying vacuum to said liquid reinforcing substance by subjecting the interior of the vessel to a vacuum to thereby deform the screen to resume its position with said slight spacing and interrupt application of said substance to said material.

9. Method according to claim 1, further comprising the step of simultaneously punching the material while applying said pressure.

* * * * *